US008226083B2

(12) United States Patent
Yanagishita

(10) Patent No.: US 8,226,083 B2
(45) Date of Patent: Jul. 24, 2012

(54) RECORDING TARGET MEDIA CASSETTE, RECORDING TARGET MEDIUM FEEDING APPARATUS, AND RECORDING APPARATUS

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/889,154

(22) Filed: Sep. 23, 2010

(65) Prior Publication Data

US 2011/0074090 A1 Mar. 31, 2011

(30) Foreign Application Priority Data

Sep. 25, 2009 (JP) ..... 2009-221279

(51) Int. Cl.
*B65H 3/34* (2006.01)

(52) U.S. Cl. ..... 271/167

(58) Field of Classification Search ..... 271/19, 271/20, 121, 145, 167
See application file for complete search history.

(56) References Cited

U.S. PATENT DOCUMENTS

| | | | | |
|---|---|---|---|---|
| 6,308,947 | B1 * | 10/2001 | Kojima et al. | 271/124 |
| 6,880,821 | B2 * | 4/2005 | Park | 271/121 |
| 7,128,317 | B2 * | 10/2006 | Johnson et al. | 271/121 |
| 7,156,388 | B2 * | 1/2007 | Kang et al. | 271/110 |
| 7,828,285 | B2 * | 11/2010 | Chu et al. | 271/167 |
| 8,083,222 | B2 * | 12/2011 | Nakano | 271/121 |
| 2004/0251602 | A1 * | 12/2004 | Ruhe et al. | 271/167 |
| 2005/0051945 | A1 * | 3/2005 | Kang | 271/121 |
| 2007/0273084 | A1 * | 11/2007 | Chu et al. | 271/162 |
| 2011/0156339 | A1 * | 6/2011 | Nakano | 271/4.11 |

FOREIGN PATENT DOCUMENTS

| | | |
|---|---|---|
| JP | 01-251045 | 10/1989 |
| JP | 02-004827 | 1/1990 |
| JP | 06-107351 | 4/1994 |
| JP | 07-267416 | 10/1995 |
| JP | 08-324803 | 12/1996 |
| JP | 09-169444 | 6/1997 |
| JP | 09-240868 | 9/1997 |
| JP | 10-087094 | 4/1998 |
| JP | 11-049392 | 2/1999 |
| JP | 2006-117362 | 5/2006 |
| JP | 2009-203031 | 9/2009 |

* cited by examiner

*Primary Examiner* — Kaitlin Joerger
*Assistant Examiner* — Patrick Cicchino
(74) *Attorney, Agent, or Firm* — Workman Nydegger

(57) ABSTRACT

A recording target medium feeding apparatus includes a body having a switching section and a feeding section that feeds a recording target medium. A recording target media cassette that receives the recording target media has an inner wall facing the leading edge of the recording target medium and switches between first and second states. In the first state, the inner wall has a predetermined angle with respect to a bottom surface of the recording target media cassette. In the second state, the inner wall has a steeper angle of inclination. In the first state, the inner wall separates the uppermost of the recording target media from a second recording target medium. In the second state, the inner wall contacts the leading edge of the recording target media loaded in the recording target media cassette and sets the leading edge of the recording target media at a uniform edge position.

4 Claims, 12 Drawing Sheets

RECORDING TARGET MEDIA CASSETTE, RECORDING TARGET MEDIUM FEEDING APPARATUS, AND RECORDING APPARATUS

BACKGROUND

1. Technical Field

The present invention relates to a recording target media cassette in which recording target media can be loaded, a recording target medium feeding apparatus that feeds a recording target medium, and a recording apparatus that is provided therewith.

2. Related Art

A recording apparatus such as a fax machine, a printer, or the like is typically provided with a paper cassette that can be attached to and detached from the body of the apparatus. In the structure of some recording apparatuses such as one disclosed in JP-A-2006-117362, an inner wall that faces the leading edge of sheets of paper stacked in a paper cassette is formed as an inclined wall so that it can function to separate the uppermost sheet, which should be fed downstream, from a second sheet and sheets under the second sheet.

A paper feeding apparatus that has a separating portion that performs separation for both thick paper and thin paper is disclosed in JP-A-7-267416. To fulfill its separating function for both types of paper, the disclosed separating portion is made up of an inclined face that is in a fixed state (hereinafter referred to as "fixed slope") and an inclined face that has a projection that can appear on and disappear from the inclined face (hereinafter referred to as "movable slope").

When the type of paper is thick paper, the uppermost sheet moves with a comparatively large force to depress the movable slope. Therefore, the disclosed paper feeding apparatus separates the uppermost sheet from the second sheet from the top on the fixed slope. Thus, the angle of the fixed slope is set at a value that is suited for thick paper.

When the type of paper is thin paper, the uppermost sheet moves with a comparatively small force. Therefore, it does not depress the movable slope. However, since the force with which the uppermost sheet moves is larger than the force with which the second sheet from the top moves, the uppermost sheet is fed downstream without being stopped by the movable slope, which is set at a steeper angle than that of the fixed slope, whereas the second sheet from the top is stopped by the movable slope.

As explained above, the paper feeding apparatus disclosed in JP-A-7-267416 utilizes a difference between the force with which the uppermost sheet moves and the force with which the second sheet from the top moves (i.e., a difference in stiffness therebetween) to selectively use a proper inclined face for separation depending thereon; that is, the fixed slope is used for separation of thick paper, whereas the movable slope is used for separation of thin paper.

However, if an inner wall that faces the leading edge of sheets of paper is inclined, due to a shock during the attachment of a paper cassette in which the sheets of paper are loaded to the body of an apparatus, there is a risk that the paper runs on the inner wall to cause a feeding failure.

In addition, when a user sets paper in the paper cassette, since the inner wall facing the leading edge of the paper is inclined, it does not give a good feel of edge contact. Because of the lack of a good feel of edge contact, the user tends to apply an excessive force thereto during the setting of the paper. For this reason, there is the same kind of a risk that the paper runs on the inner wall to cause a feeding failure.

SUMMARY

An advantage of some aspects of the invention is to provide a technique for preventing the leading edge of paper from running on an inner wall of a paper cassette when paper is set or when the paper cassette is attached to the body of an apparatus having a structure in which the inner wall, which faces the leading edge of the paper, is inclined to fulfill a separating function.

A first mode of the invention is directed to a recording target media cassette having the following features. Recording target media can be loaded in a stacked state in the recording target media cassette. The recording target media cassette has an inner wall that faces the leading edge of the recording target medium (media) that is to be fed. The state of the inner wall can be switched over between a first state and a second state. In the first state, the inner wall is inclined in recording target medium feeding orientation in such a manner that an angle of the inner wall with respect to a bottom surface of the recording target media cassette is set at a predetermined angular value. In the second state, the inner wall is set at a steeper angle of inclination in comparison with the angle in the first state.

As stated above, in the recording target media cassette, a state of the inner wall facing the leading edge of the recording target medium is able to be switched over between the first state in which the inner wall is inclined in recording target medium feeding orientation in such a manner that an angle of the inner wall with respect to a bottom surface of the recording target media cassette is set at a predetermined angular value and the second state in which the inner wall is set at a steeper angle of inclination in comparison with the angle in the first state. Therefore, with the above mode, when it is set in the first state, the inner wall functions to separate the uppermost one of the recording target media, which should be fed downstream, from a second recording target medium from the top and subsequent recording target media thereunder on which a force of being fed together with the uppermost one might act (this function is hereinafter referred to as "separating function" of the inner wall).

Since the inner wall is set at a steeper angle of inclination in comparison with the angle in the first state when it is set in the second state, it gives a good feel of edge contact at the time of setting the recording target media. The inner wall set in the second state prevents the leading edge of the recording target media from running on the inner wall due to an excessive force applied thereto during the setting. Moreover, when the recording target media cassette in which the recording target media are loaded is attached to the body of an apparatus, it prevents the leading edge of the recording target media from running on the inner wall due to a shock during the attachment. Furthermore, when the state of the inner wall is switched over from the first state to the second state, it can set the edge position of the recording target media in a uniform manner when not uniform.

A second mode of the invention is characterized in that, in addition to the features of the first mode, when the inner wall is set in the first state, the inner wall functions to separate the uppermost one of the recording target media, which should be fed downstream, from a second recording target medium from the top and subsequent recording target media thereunder, and when the inner wall is set in the second state, the inner wall is in contact with the leading edge of the recording target media loaded in the recording target media cassette and functions to properly set the leading edge of the recording target media at a uniform edge position.

With the above mode, the inner wall can fulfill its separating function when it is set in the first state. When it is set in the second state, it gives a good feel of edge contact at the time of setting the recording target media. Moreover, when the recording target media cassette is attached to the body of the apparatus, it prevents the leading edge of the recording target media from running on the inner wall due to a shock during the attachment. Furthermore, when the state of the inner wall is switched over from the first state to the second state, it can set the edge position of the recording target media in a uniform manner when not uniform.

A third mode of the invention is characterized in that, in addition to the features of the first mode or the second mode, the angle of the inner wall with respect to the bottom surface of the recording target media cassette in the second state is set at 90°. With the above mode, since the angle of the inner wall with respect to the bottom surface of the recording target media cassette in the second state is set at 90°, it gives a better feel of edge contact at the time of setting the recording target media. Moreover, when the recording target media cassette is attached to the body of the apparatus, it prevents the leading edge of the recording target media from running on the inner wall with greater reliability.

A fourth mode of the invention is directed to a recording target medium feeding apparatus that includes a feeding section that feeds a recording target medium (media) and the recording target media cassette according to any of the first, second, and third modes, which is detachably attached to the body of the apparatus. In a recording target medium feeding apparatus, the above mode can offer the same working effects as those of any of the first, second, and third modes.

In addition to the features of the fourth mode, a fifth mode of the invention has the following features. The inner wall is set in the second state when the recording target media cassette is not attached to the body. The body includes a switching section. When recording target medium feeding operation is performed, the switching section switches over the state of the inner wall from the second state to the first state before the leading edge of the recording target medium (media) that is to be fed is brought into contact with the inner wall at the latest.

With the above mode, since the switching section switches over the state of the inner wall from the second state to the first state before the leading edge of the recording target medium that is to be fed is brought into contact with the inner wall at the latest when recording target medium feeding operation is performed, the inner wall can fulfill its separating function reliably.

In addition to the features of the fourth mode, a sixth mode of the invention has the following features. The inner wall is set in the second state when the recording target media cassette is not attached to the body. The body includes a switching section. In a state in which the recording target media cassette is attached to the body, the switching section switches over the state of the inner wall depending on the state of feeding of the recording target medium, specifically, into the first state during feeding and into the second state during non-feeding.

With the above mode, since the switching section switches over the state of the inner wall depending on the state of feeding of the recording target medium, specifically, into the first state during feeding and into the second state during non-feeding, the inner wall can fulfill its separating function reliably. Moreover, when recording target media are set additionally during non-feeding, it is possible to prevent the leading edge of the recording target media from running on the inner wall.

A seventh mode of the invention is characterized in that, in addition to the features of the fifth mode or the sixth mode, the switching section keeps the state of the inner wall in the second state until the recording target media cassette with the inner wall being set in the second state is attached to the body and then initial recording target medium feeding operation starts.

With the above mode, since the state of the inner wall is kept in the second state until initial recording target medium feeding operation starts, when the recording target media cassette is attached to the body of the apparatus, it is possible to prevent the leading edge of the recording target media from running on the inner wall due to a shock during the attachment with greater reliability.

In addition to the features of the fourth mode, an eighth mode of the invention has the following features. The body includes a switching section that switches over the state of the inner wall. The recording target media cassette includes an engagement section that is brought into engagement with the switching section when the recording target media cassette is attached to or detached from the body of the recording target medium feeding apparatus. The state of the inner wall is switched over from the second state to the first state when the recording target media cassette is attached to the body. The state of the inner wall is switched over from the first state to the second state when the recording target media cassette is detached from the body.

With the above mode, the attachment of the recording target media cassette to the body or the detachment thereof from the body is utilized to switch over the state of the inner wall, which makes it unnecessary to provide a power source for the switchover. Thus, it is possible to avoid a complex structure and an increase in cost.

In addition to the features of the fifth mode, a ninth mode of the invention has the following features. The recording target media cassette further includes a swiveling member and a posture holding section. The swiveling member has the inner wall and swivels to switch over the state of the inner wall. The posture holding section holds posture of the swiveling member when the inner wall is in the second state. The posture holding section can be brought into engagement with the switching section. The swiveling member is configured to swivel in such a manner that the state of the inner wall is switched into the first state due to weight of the swiveling member of its own in a state in which the holding of the posture of the swiveling member by the posture holding section is released.

With the above mode, the swiveling member having the inner wall can swivel to switch over the state of the inner wall from the second state to the first state due to its own weight. Therefore, it is not necessary to provide any other means for the switchover from the second state to the first state. Thus, it is possible to avoid a complex structure and an increase in cost.

In addition to the features of the ninth mode, a tenth mode of the invention has the following features. The posture holding section includes a lock pin that is provided on the swiveling member. The lock pin can move into and out of a fitting hole that is formed adjacent to the swiveling member. The lock pin is urged toward the fitting hole. The lock pin is inserted into the fitting hole to hold the posture of the swiveling member. The switching section includes a lock release member that can be brought into engagement with the lock pin or a lock member that includes the lock pin. The lock release member is brought into engagement with the lock pin or the lock member in operative association with operation of feeding the recording target medium by the feeding section to disengage the lock pin from the fitting hole.

With the above mode, since the lock pin keeps the state of the inner wall in the second state, and since the lock release member that can be brought into engagement with the lock pin either directly or indirectly releases the second state, it is possible to provide an apparatus having a simple structure at low cost.

An eleventh mode of the invention is characterized in that, in addition to the features of the tenth mode, power of a power source for the feeding section is utilized for mechanically operating the lock release member to disengage the lock pin from the fitting hole.

With the above mode, since power of a power source for the feeding section is utilized for mechanically operating the lock release member to disengage the lock pin from the fitting hole, the shared mechanism makes it possible to avoid a complex structure and an increase in cost.

In addition to the features of any of the ninth, tenth, and eleventh modes, a twelfth mode of the invention has the following features. A cam member is provided on the body of the recording target medium feeding apparatus at a position adjacent to the recording target media cassette. The swiveling member is brought into engagement with the cam member to switch over the state of the inner wall from the first state to the second state when the recording target media cassette is detached from the body.

With the above mode, since the state of the inner wall is switched over from the first state to the second state by utilizing the detachment of the recording target media cassette from the body, it is unnecessary to provide a power source for the switchover. Thus, it is possible to avoid a complex structure and an increase in cost.

A thirteenth mode of the invention is directed to a recording target medium feeding apparatus having the following features. The apparatus includes a recording target media loaded section in which recording target media can be loaded in a stacked state and a feeding section that feeds the recording target medium from the recording target media loaded section. The recording target media loaded section has an inner wall that faces the leading edge of the recording target medium that is to be fed. The state of the inner wall can be switched over between a first state and a second state. In the first state, the inner wall is inclined in recording target medium feeding orientation in such a manner that an angle of the inner wall with respect to a bottom surface of the recording target media loaded section is set at a predetermined angular value. In the second state, the inner wall is set at a steeper angle of inclination in comparison with the angle in the first state.

With the above mode, the inner wall can fulfill its separating function when it is set in the first state as done in the first mode. When it is set in the second state, it gives a good feel of edge contact at the time of setting the recording target media. Moreover, when the recording target media loaded section is attached to the body of the apparatus, it prevents the leading edge of the recording target media from running on the inner wall due to a shock during the attachment.

A fourteenth mode of the invention is directed to a recording apparatus that includes the recording target media cassette according to any of the first, second, and third modes or the recording target medium feeding apparatus according to any of the fourth to thirteenth modes. In a recording apparatus, the above mode can offer the same working effects as those of any of the first to thirteenth modes.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
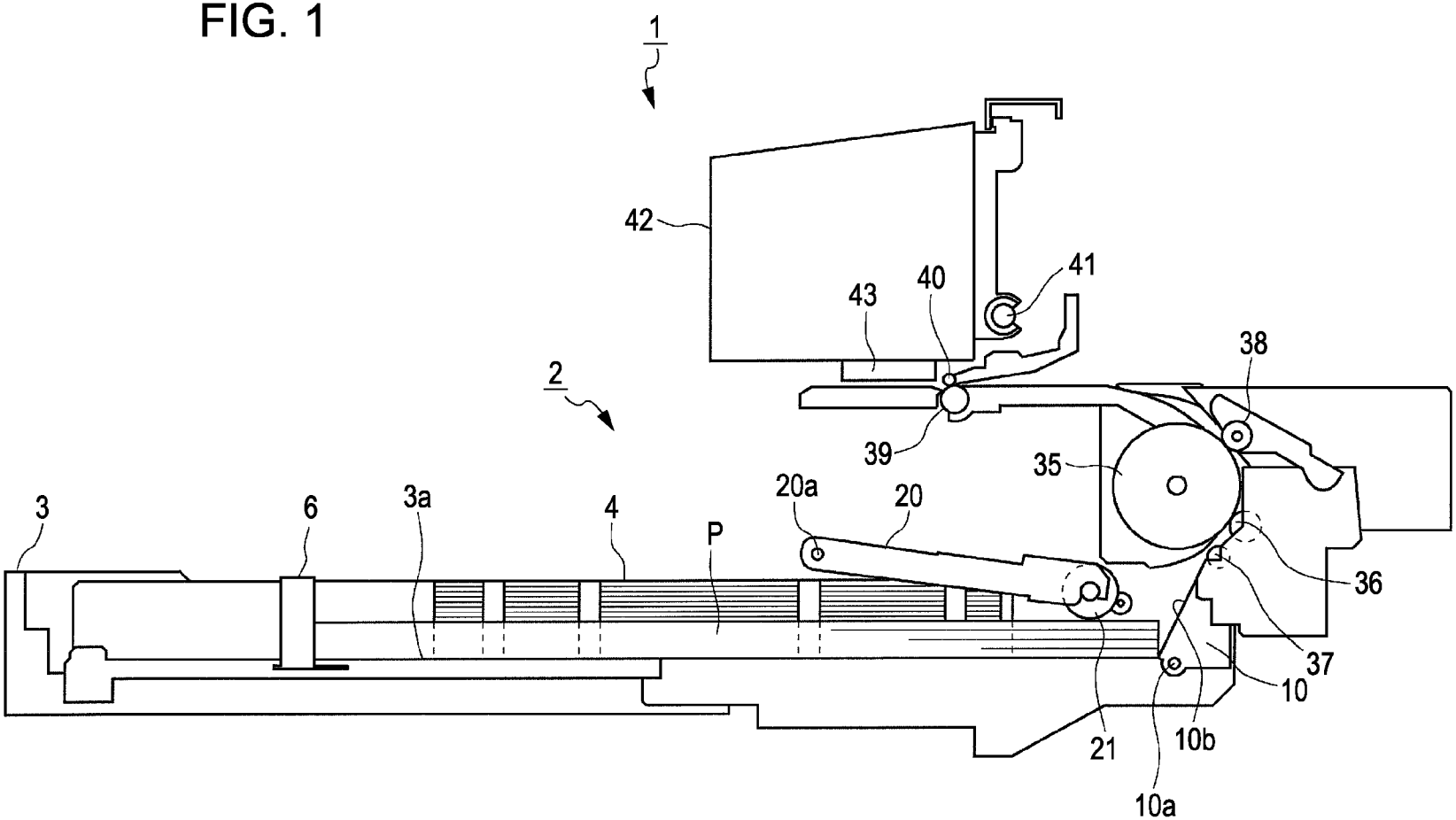
FIG. 1 is a side sectional view that schematically illustrates the paper transport path of a recording apparatus according to an exemplary embodiment of the invention.
Figure 2A:
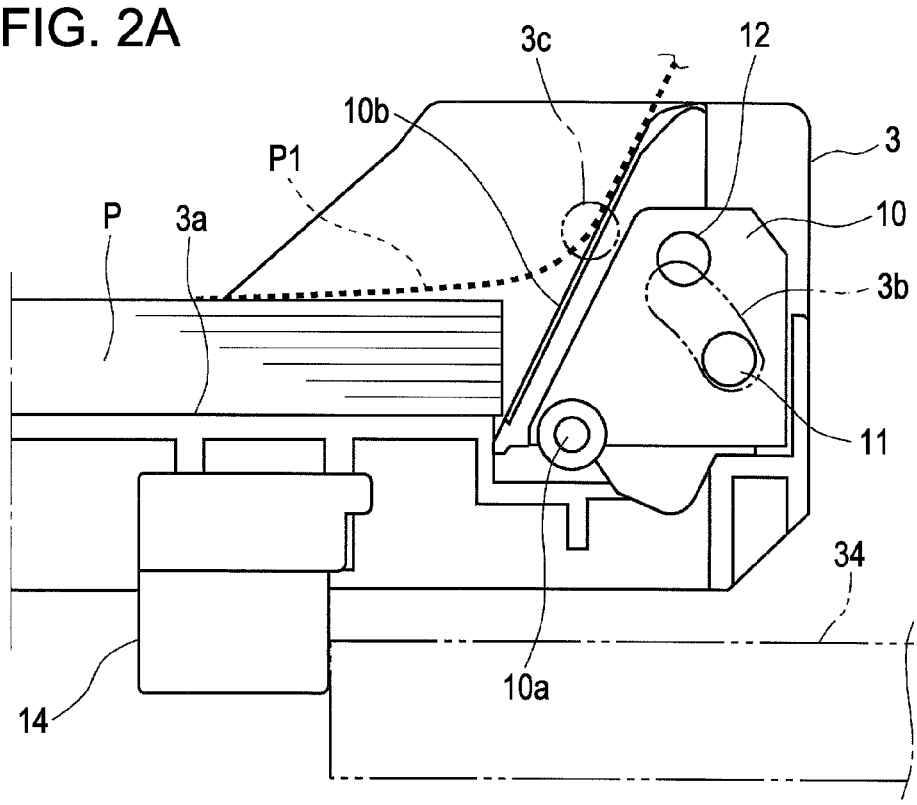
FIG. 2A is a diagram that shows a separating slope set in a first state.
Figure 2B:
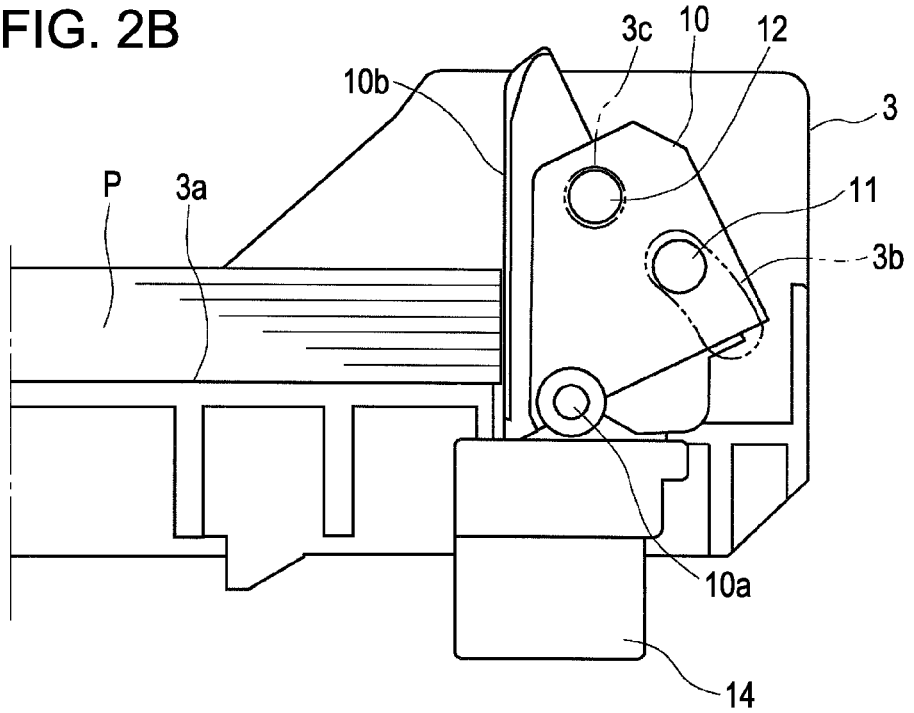
FIG. 2B is a diagram that shows the separating slope set in a second state.
Figure 10:
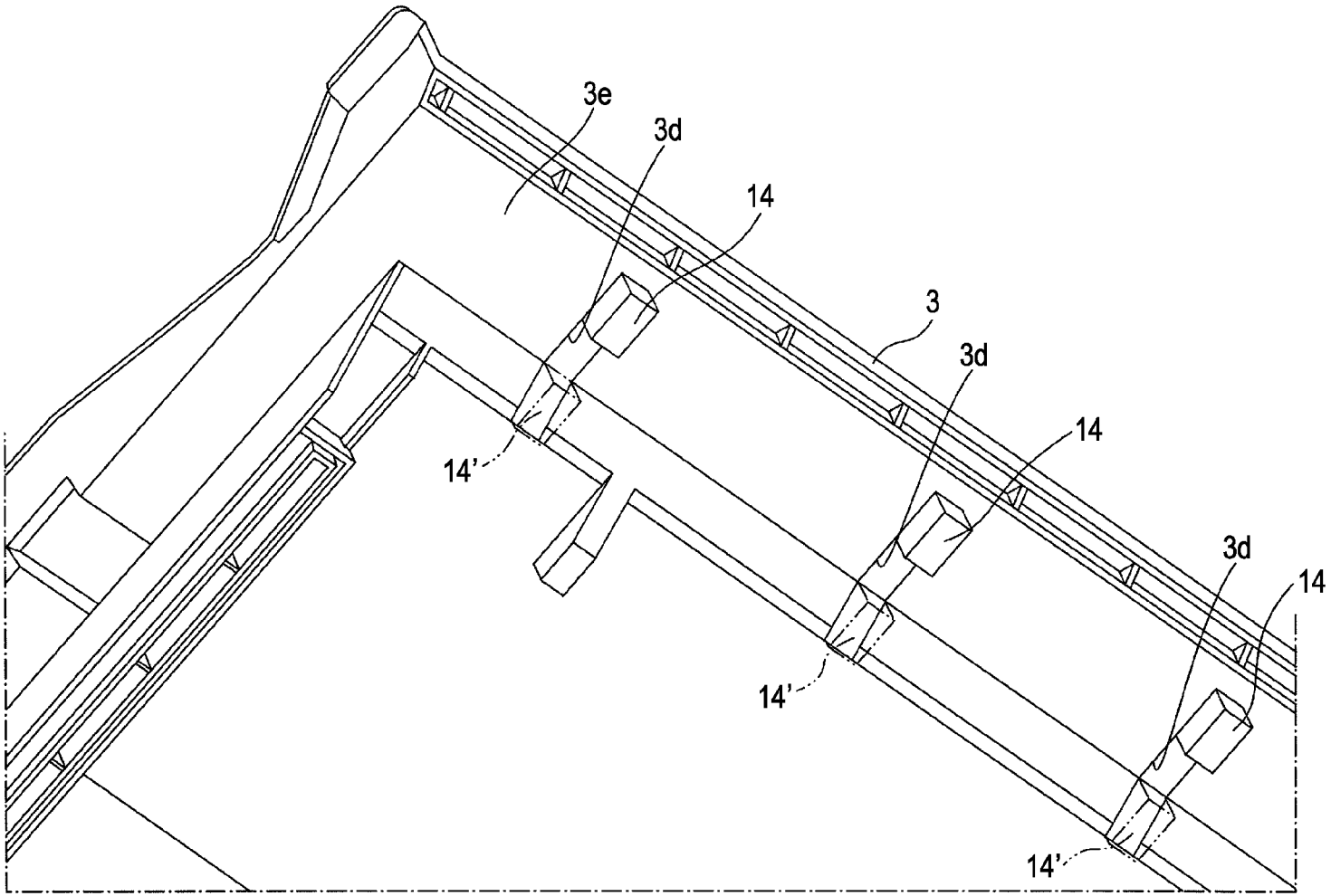
FIG. 10 is a perspective view that schematically illustrates an example of the essential components of the paper cassette looked from down below.
Figure 11:
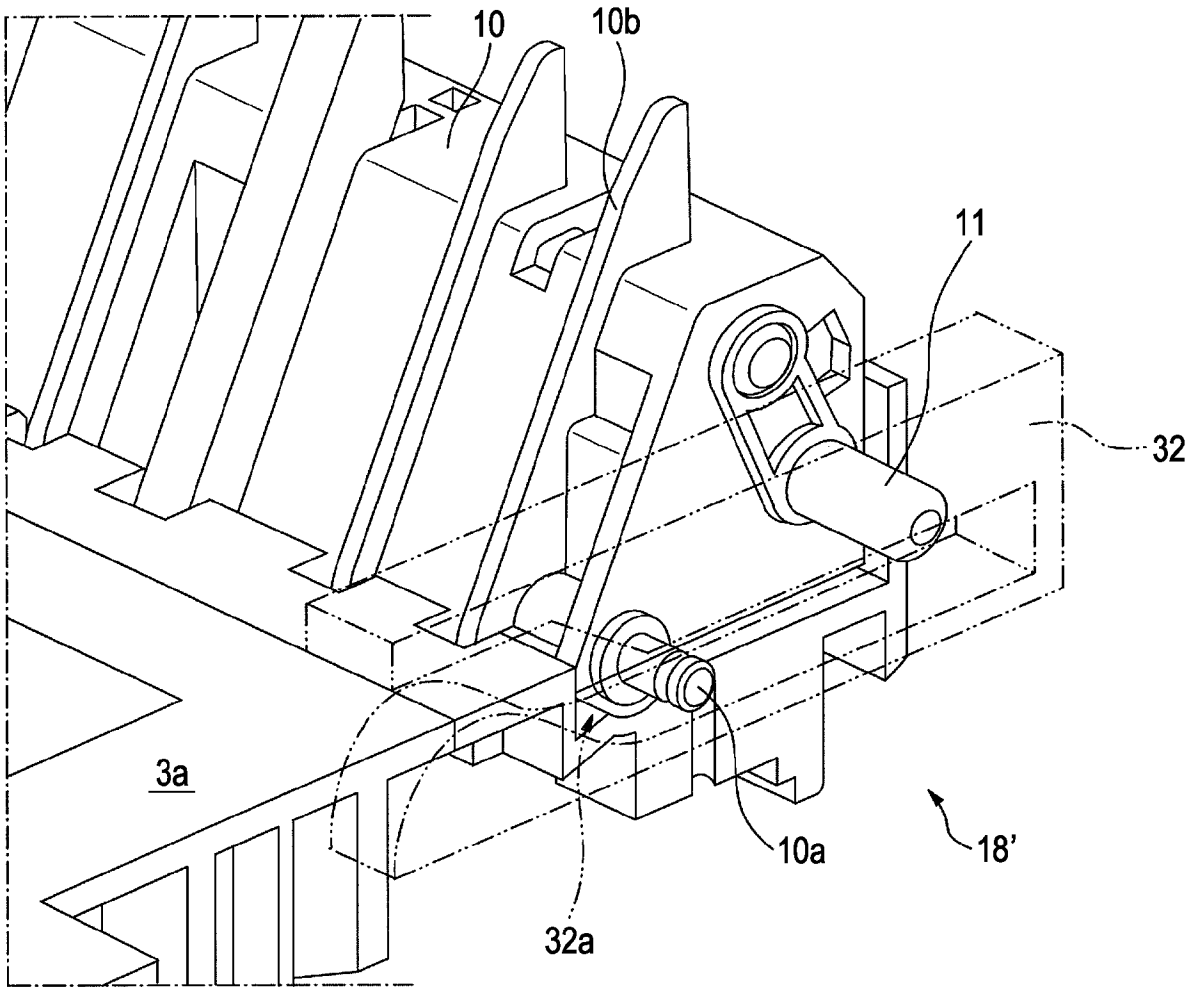
FIG. 11 is a perspective view that schematically illustrates an example of the essential components of the paper cassette and a switching means according to another exemplary embodiment of the invention.
Figure 12:
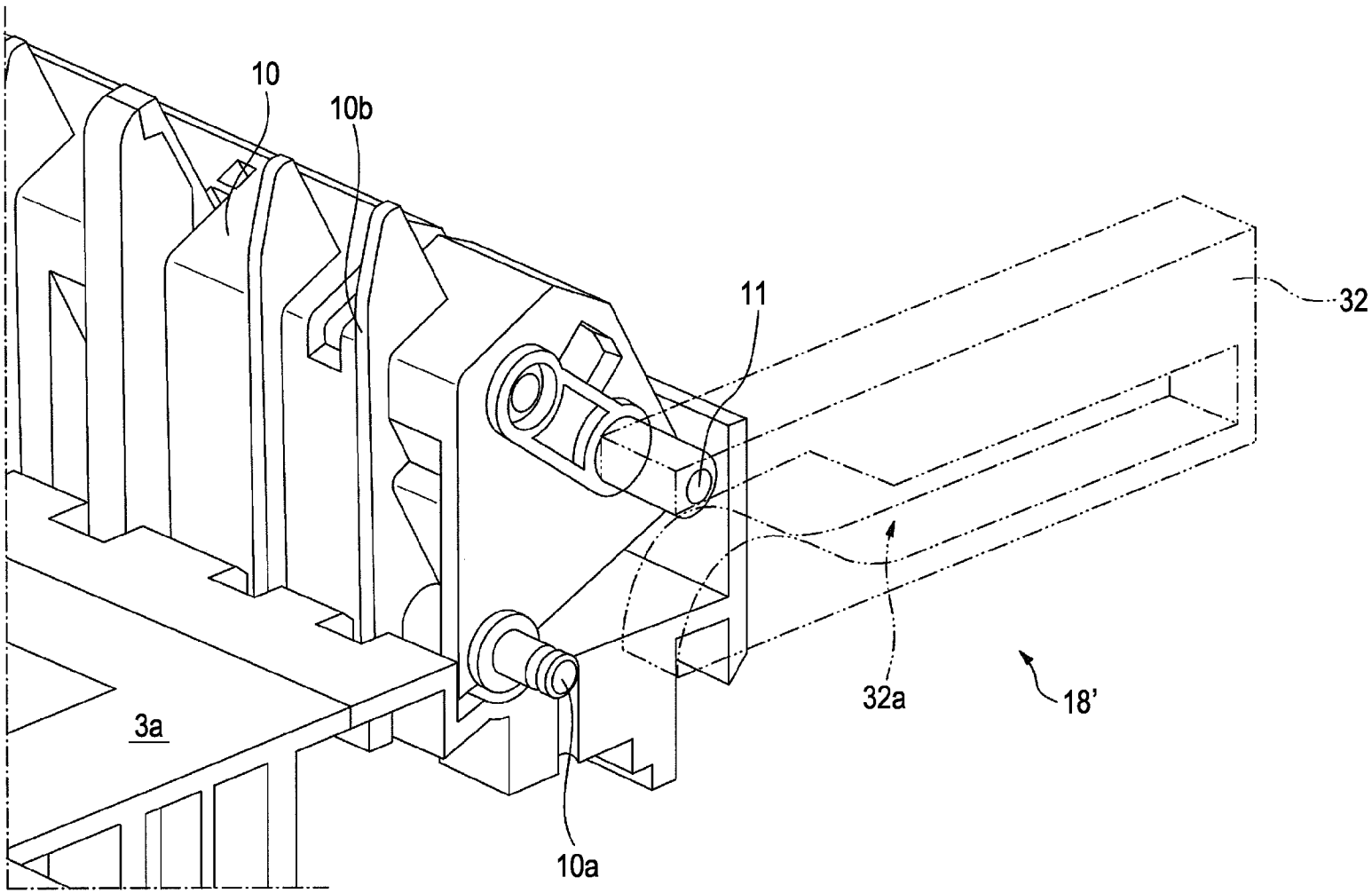
FIG. 12 is a perspective view that schematically illustrates an example of the essential components of the paper cassette and the switching means according to another exemplary embodiment of the invention.

With reference to the accompanying drawings, exemplary embodiments of the present invention will now be explained in detail. FIG. 1 is a side sectional view that schematically illustrates the paper transport path of an ink-jet printer 1, which is an example of a recording apparatus according to an exemplary embodiment of the invention. FIG. 2 is a set of side sectional views that schematically illustrates an example of the essential components of a paper cassette 3 according to an exemplary embodiment of the invention. FIG. 2A is a diagram that shows a separating slope 10*b* set in a first state. FIG. 2B is a diagram that shows the separating slope 10*b* set in a second state. Each of FIGS. 3 and 5 to 9 is a perspective view that schematically illustrates an example of the essential components of the paper cassette 3 and a switching means 18 according to an exemplary embodiment of the invention. FIG. 4 is a front view that schematically illustrates an example of the essential components thereof. FIG. 10 is a perspective view that schematically illustrates an example of the essential components of the paper cassette 3 looked from down below. Each of FIGS. 11 and 12 is a perspective view that schematically illustrates an example of the essential components of a switching means 18' according to another exemplary embodiment of the invention.

In each of FIGS. 3 to 12, some constituent member(s) may not be shown so as to show another constituent member(s) that is (are) actually hidden behind the omitted constituent member(s) for the purpose of explanation. Therefore, members shown as the components of the illustrated part of the ink-jet printer 1 may not be all of the components that constitute it actually. As will be explained later, a plurality of ribs, which constitute a separating slope 10*b*, are formed next to one another on a paper cassette 3 in the direction of the width of paper. In each of FIGS. 3, 5 to 9, 11, and 12, a reference mark is shown for only one rib to simplify illustration.

First of all, the overall structure of the ink-jet printer 1 is explained below. The ink-jet printer 1 is equipped with a paper feed unit 2 according to an exemplary embodiment of the invention. The paper feed unit 2 is provided at the bottom part of the ink-jet printer 1. The paper feed unit 2, which includes a paper cassette 3, feeds recording paper P from the paper cassette 3. The recording paper P is an example of a recording target medium according to an aspect of the invention. The recording paper P is curved around an intermediate roller 35 to change its direction of transportation. After the curve, the recording paper P is fed toward an ink-jet recording head 43 for recording thereat. More specifically, besides the paper cassette 3 and the intermediate roller 35, the paper feed unit 2 includes a pickup roller 21, a retard roller 36, and guide rollers 37 and 38.

The paper cassette 3 is detachably attached to the paper feed unit 2. Edge guides 4 and 6 are provided as movable members on the paper cassette 3. The positions of the edge guides 4 and 6 can be set in accordance with paper size. The edge guides 4 and 6 mechanically determine the positions of a side edge and the rear edge of sheets of the recording paper P. The edge guide 4 is one of a pair of side guides for mechanically determining the position of one side edge of sheets of the recording paper P. Another edge guide that is not illustrated in the drawings is provided as the other of the pair of side guides for mechanically determining the position of the other side edge of the sheets of the recording paper P. The edge guide 6 is a rear guide for mechanically determining the position of the rear edge of the sheets of the recording paper P.

A separating member 10, which has the rib-shaped separating slope 10*b*, is provided at a position where the separating slope 10*b* faces the leading edge of sheets of the recording paper P stacked in the paper cassette 3. The separating member 10 is an example of a swiveling member according to an aspect of the invention. When the pickup roller 21 picks up the recording paper P to feed it downstream, the leading edge of the recording paper P is brought into contact with the separating slope 10*b*. The picked-up recording paper P is fed while being in contact with the separating slope 10*b* in a sliding manner at its leading edge part (i.e., leading edge region) first. When more than one sheet of the recording paper P is picked up together (i.e., double/multi-feeding), the uppermost sheet, which should be fed downstream, is separated from the remaining sheets picked up together at the separating slope 10*b* as a preparatory separation step. A more detailed explanation of the separating slope 10*b* will be given later.

The pickup roller 21, which is a component of a paper feeding means, is supported rotatably on a swiveling arm member 20. The swiveling arm member 20 can operate in a swiveling manner around a swiveling shaft 20*a* in the clockwise direction and the counterclockwise direction shown in FIG. 1. The power of a driving motor that is not illustrated in the drawings is transmitted to the pickup roller 21. The pickup roller 21 rotates when driven by the motor. In paper feeding operation, the pickup roller 21 rotates while being in contact with the uppermost one of sheets of the recording paper P stacked in the paper cassette 3. By this means, the uppermost sheet of the recording paper P is fed from the paper cassette 3. A more detailed explanation of a mechanism that causes the swiveling arm member 20 to operate in a swiveling manner will be given later.

Figure 3:
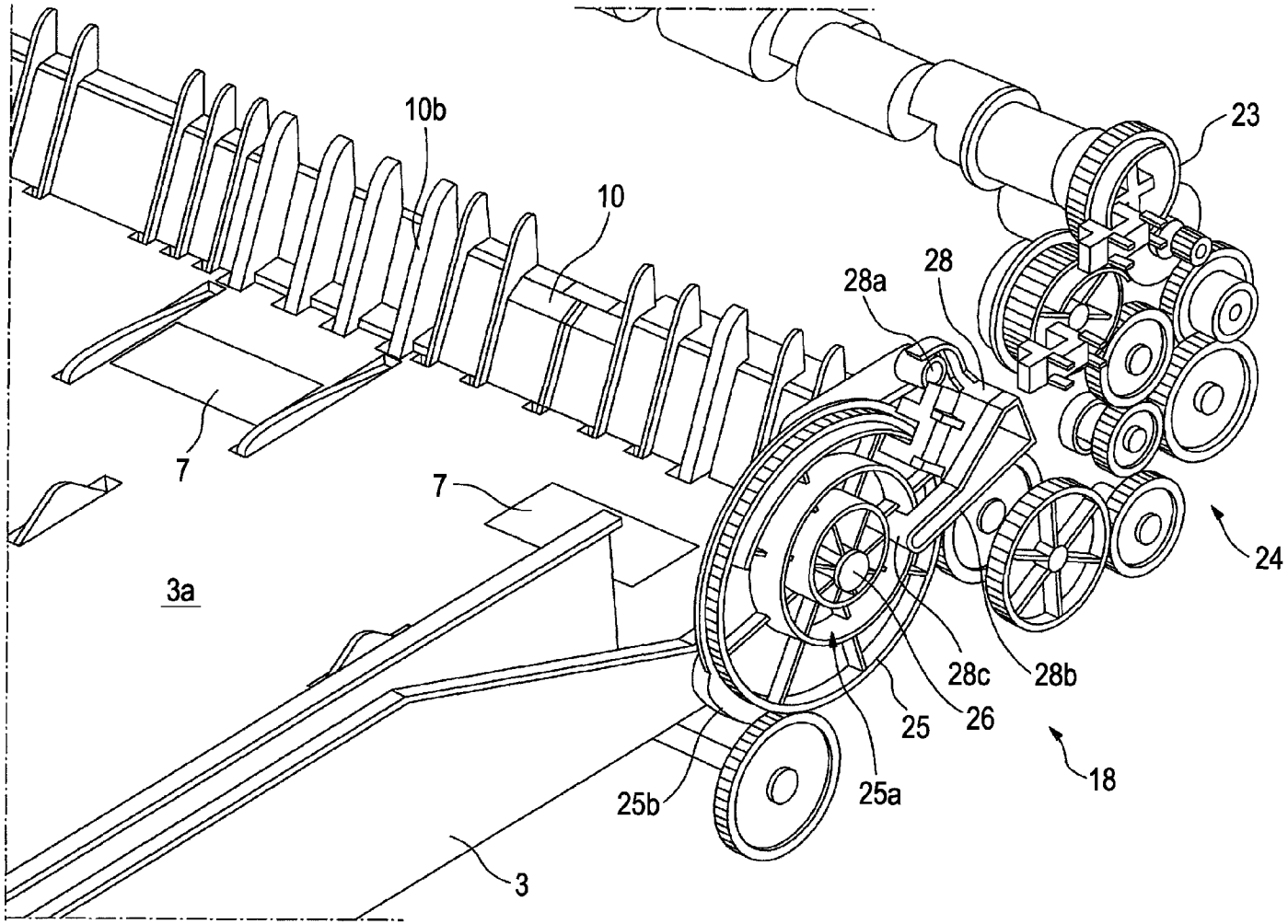
FIG. 3 is a perspective view that schematically illustrates an example of the essential components of a paper cassette and a switching means according to an exemplary embodiment of the invention.
Figure 4:
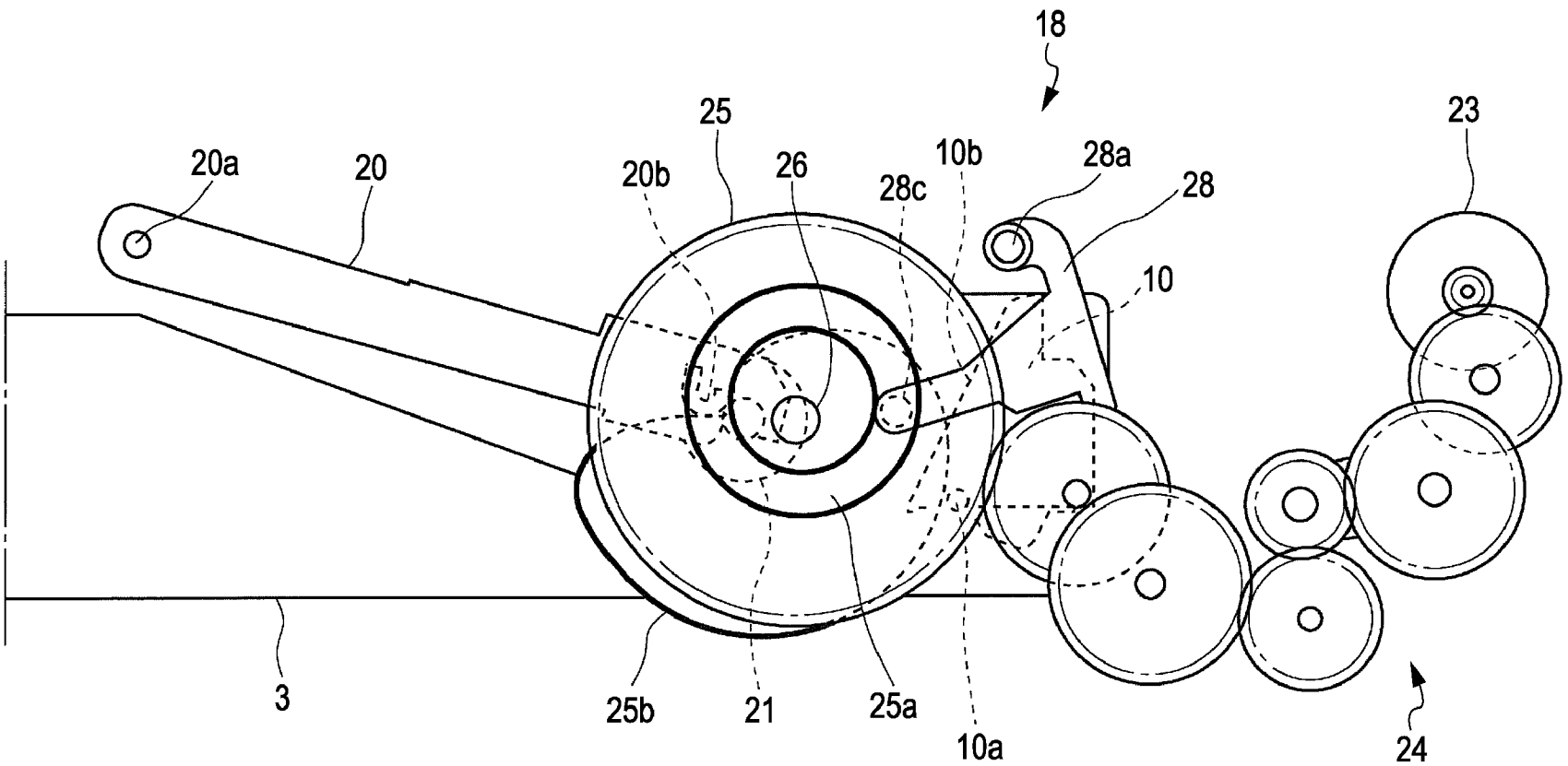
FIG. 4 is a front view that schematically illustrates an example of the essential components of the paper cassette and the switching means according to an exemplary embodiment of the invention.

As illustrated in FIG. 3, frictional pads 7 are provided on the bottom surface 3*a* of the paper cassette 3. When the pickup roller 21 applies a downward pressing force to the stacked sheets of the recording paper P from above, the lowermost sheet thereof is pressed against the frictional pads 7. Accordingly, a frictional resistance appears between the lowermost sheet and the frictional pads 7. The frictional pads 7 have a function of preventing the entire stack of the recording paper P from being fed at one time. One of the plurality of frictional pads 7 is provided at the position of the pickup roller 21 in a plan view.

Next, a part of a sheet of the recording paper P fed upward from the paper cassette 3 enters a curve region of the paper transport path at which its direction of transportation is reversed along the curve. This region is hereinafter referred to as "curve reversal region". The intermediate roller 35, the retard roller 36, and the guide rollers 37 and 38 are provided at the curve reversal region.

The intermediate roller 35 is a major roller that has a comparatively large diameter. The intermediate roller 35 is provided as the inner roller around which the recording paper P is curved to change its direction of transportation at the curve reversal region. The power of a driving motor that is not illustrated in the drawings is transmitted to the intermediate roller 35. The intermediate roller 35 rotates when driven by the motor. As the intermediate roller 35 rotates in the counterclockwise direction shown in FIG. 1, the recording paper P is fed downstream along the circumferential surface thereof.

The retard roller 36 is provided as a contact/release roller that can be brought into contact with the intermediate roller 35 and moved away from the intermediate roller 35. A predetermined frictional rotation resistance is applied to the retard roller 36. The recording paper P is nipped between the intermediate roller 35 and the retard roller 36. By this means, when a force of being fed together with the uppermost sheet of the recording paper P, that is, a force of double feeding, acts on the second sheet from the top and sheets under the second sheet, the uppermost sheet, which should be fed downstream, is separated from the second sheet and the sheets under the second sheet.

Paper return levers that are not illustrated in the drawings are provided at this region of the paper transport path. The paper return levers are configured to return the second sheet from the top and the sheets under the second sheet, the movement of which has now been stopped by the retard roller 36, to the paper cassette 3.

The guide rollers 37 and 38 are rollers that can rotate freely. The recording paper P is nipped between the intermediate roller 35 and the guide roller 38. The guide roller 38 supports the paper transporting operation of the intermediate roller 35.

The paper feed unit 2 is made up of the components explained above. The ink-jet printer 1, which is provided with the paper feed unit 2, is further provided with a driving transportation roller 39 and a driven transportation roller 40 downstream of the intermediate roller 35. The power of a driving motor that is not illustrated in the drawings is transmitted to the driving transportation roller 39. The recording paper P is nipped between the driving transportation roller 39 and the driven transportation roller 40. The driven transportation roller 40 rotates as a follower when the recording paper P is transported.

The ink-jet recording head 43, which functions as a means for recording, is provided downstream of the driving transportation roller 39. The ink-jet recording head 43 is mounted at the bottom of a carriage 42. When driven by a driving motor that is not illustrated in the drawings, the carriage 42 reciprocates in the main scan direction. The main scan direction is the direction perpendicular to the sheet face of FIG. 1.

A paper ejecting means that is not illustrated in the drawings is provided downstream of the ink-jet recording head 43. After the completion of recording operation, the paper ejecting means is configured to eject the recording paper P to a stacker that is not illustrated in the drawings. The ink-jet printer 1 is made up of the fundamental components explained above.

Next, with reference to FIG. 2 and subsequent drawings, the paper cassette 3 is explained in detail below. The paper cassette 3 according to the present embodiment of the invention is characterized in that the angle of the separating slope 10*b*, which serves as an inner wall that faces the leading edge of sheets of the recording paper P stacked in the paper cassette 3, with respect to the bottom surface 3*a* of the paper cassette 3 can be switched over.

FIG. 2A shows the first state in which the separating surface (i.e., separating slope) 10*b* is inclined in the paper feeding orientation in such a manner that the angle of the separating slope 10*b* with respect to the bottom surface 3*a* of the paper cassette 3 is set at a predetermined angular value. When it is set in the first state, the separating slope 10*b* functions to separate the uppermost sheet of the recording paper P, which should be fed downstream, from the second sheet from the top and sheets under the second sheet on which a force of being fed together with the uppermost sheet might act. In FIG. 2A, the reference mark P1 denotes the uppermost sheet of the recording paper P. As illustrated therein, the recording paper P is fed while being in contact with the separating slope 10*b* in a sliding manner at its leading edge part first. In this sliding contact process, the separating slope 10*b* carries out its separating function.

FIG. 2B shows the second state in which the separating slope 10*b* is set at a steeper angle of inclination, which is closer to the perpendicular orientation, in comparison with the angle in the first state (i.e., inclined). When it is set in the second state, the separating slope 10*b* functions to properly set the leading edge of the sheets of the recording paper P stacked in the paper cassette 3 at a uniform edge position. For example, when the edge guide 6 (refer to FIG. 1) is brought into contact with the rear edge of the sheets of the recording paper P with a moderate force in a colliding manner, the leading edge thereof is brought into contact with the separating slope 10*b*. As a result, the edge of the sheets will be set at the proper uniform position. In the present embodiment of the invention, the angle of the separating "slope" 10*b* with respect to the bottom surface 3*a* of the paper cassette 3 in the second state is set at 90° (i.e., perpendicular).

With the above structure of the paper cassette 3, the state of the separating slope 10*b*, which serves as an inner wall that faces the leading edge of sheets of the recording paper P, can be switched over between the first state (i.e., inclined) and the second state (i.e., perpendicular). Therefore, in the first state in which the angle of the separating slope 10*b* with respect to the bottom surface 3*a* of the paper cassette 3 is set at a predetermined angular value, the separating slope 10*b* carries out its separating function. When it is set in the second state, the separating slope 10*b* gives a good feel of edge contact at the time of setting sheets of the recording paper P. The separating slope 10*b* set in the second state prevents the leading edge of the recording paper P from running on the separating slope 10*b* due to an excessive force applied thereto during the setting. The feeding of plural sheets together is also prevented.

Moreover, when the paper cassette 3 in which sheets of the recording paper P are stacked is attached to the body of the paper feed unit 2, it prevents the leading edge of the recording paper P from running on the separating slope 10*b* due to a shock during the attachment. Furthermore, when the state of the separating slope 10*b* is switched over from the first state (i.e., inclined) to the second state (i.e., perpendicular), it can set the edge position of sheets in a uniform manner when not uniform due to paper feeding operation.

In FIG. 2, the reference numeral 14 denotes a fixing block. The fixing block 14 can slide on the paper cassette 3 in the direction of the attachment of the paper cassette 3. The cassette attachment direction is the horizontal direction of FIG. 2. An urging means that is not illustrated therein urges the fixing block 14 to the right in FIG. 2, that is, toward the front end of the paper cassette 3.

A first function of the fixing block 14 is to support the separating member 10 from beneath, thereby keeping the state of the separating slope 10*b* in the second state (i.e., perpendicular) (refer to FIG. 2B). With the above function of the fixing block 14, it is possible to ensure that the separating slope 10*b* is in the second state when the paper cassette 3 is not attached to the paper feed unit 2. At the time of cassette attachment, the fixing block 14 is brought into contact with a body-side contact portion 34, which is provided on the body of the paper feed unit 2. As it is pressed by body-side contact portion 34 in the course of the cassette attachment, the fixing block 14 slides in a retracting manner from the position under the separating member 10 (refer to FIG. 2A and the slid block shown by a virtual line 14' in FIG. 10). Therefore, when the paper cassette 3 is attached to the paper feed unit 2, the fixing block 14 does not obstruct the swiveling operation of the swiveling member 10.

A second function of the fixing block 14 is to prevent the separating member 10, which is elongated in the direction of the width of paper, from deflecting. Since the separating member 10 is elongated in the direction of the width of paper, the center part of the separating member 10 is more susceptible to deflection due to its own weight. In view of such mechanical property, a plurality of the fixing blocks 14 is provided at predetermined intervals in the direction of the width of paper as illustrated in FIG. 10. With such a structure, the deflection of the center part of the separating member 10 is prevented.

Next, a mechanism that switches over the state of the separating slope 10*b* is explained in detail below. As illustrated in FIGS. 2A and 2B, the separating slope 10*b* is formed as a part of the separating member 10, which can operate in a swiveling manner around a swiveling shaft 10*a* as an example of a swiveling member. As illustrated in FIG. 3, the separating slope 10*b* is formed as the roof part of each of a plurality of ribs. The plurality of ribs is formed at predetermined intervals in the direction of the width of paper. As a result of the swiveling operation of the separating member 10, the state of the separating slope 10*b* is switched over between the first state (i.e., inclined) and the second state (i.e., perpendicular).

The separating member 10 is provided with a lock pin 12 that can move into and out of a fitting hole 3*c*. The fitting hole 3*c* is formed adjacent to the separating member 10 through a side of the paper cassette 3 (refer to FIG. 9). An urging means that is not illustrated therein urges the lock pin 12 toward the fitting hole 3*c*. When the lock pin 12 is inserted in the fitting hole 3*c* (refer to FIG. 2B), the separating member 10 (the separating slope 10*b*) is locked in the second state (i.e., perpendicular). The lock pin 12 is an example of a posture holding section according to an aspect of the invention for keeping the state (e.g., position, orientation, inclination, or the like) of the swiveling member 10 (the separating slope 10*b*) in the second state (i.e., perpendicular).

A boss 11 that protrudes toward the side of the paper cassette 3 in the same way as the lock pin 12 does is provided in the vicinity of the lock pin 12. The boss 11 is movably inserted in a fan-shaped slot 3*b*, which is formed through the side of the paper cassette 3 (refer to FIG. 9). The boss 11 and the lock pin 12 constitute a single member as an example of a lock member according to an aspect of the invention. A switching means 18 that will be explained later pushes the boss 11 inward. When the boss 11 is pushed inward, the lock pin 12 becomes disengaged from the fitting hole 3*c*. As a result, the separating member 10 is released from the second state (i.e., perpendicular) (refer to FIG. 2A).

When the separating member 10 is set in the state shown in FIG. 2B, its position of the center of gravity (which means a position in the horizontal direction of FIG. 2B) is away from the swiveling shaft 10*a* (i.e., at the right side of FIG. 2B). Therefore, when the lock pin 12 becomes disengaged from the fitting hole 3*c* to release the separating member 10 from the second state (i.e., perpendicular), the separating member 10 swivels into the first state (i.e., inclined) due to its own weight. To increase the reliability of the switchover operation, an urging means that is not illustrated in the drawings (note that the urging means constitutes a part of the switching means 18) may urge the separating member 10. In such a structure, the state of the separating slope 10*b* is switched over from the second state (i.e., perpendicular) to the first state (i.e., inclined) due to an urging force applied by the urging means and the weight of the separating member 10 of its own.

The switching means 18 for pushing the boss 11 inward is explained below. In each of FIGS. 3 to 8, the reference numeral 28 denotes a lock release member (which constitutes a part of the switching means 18). The lock release member 28 is brought in engagement with the boss 11 to disengage the lock pin 12 from the fitting hole 3*c*. The lock release member 28 can operate in a swiveling manner around a swiveling shaft 28*a*. A boss portion 28*c* is formed at the tip of an arm portion 28*b* of the lock release member 28. In addition, the lock release member 28 includes a boss pushing portion 28*d* next to the arm portion 28*b*.

Figure 6:
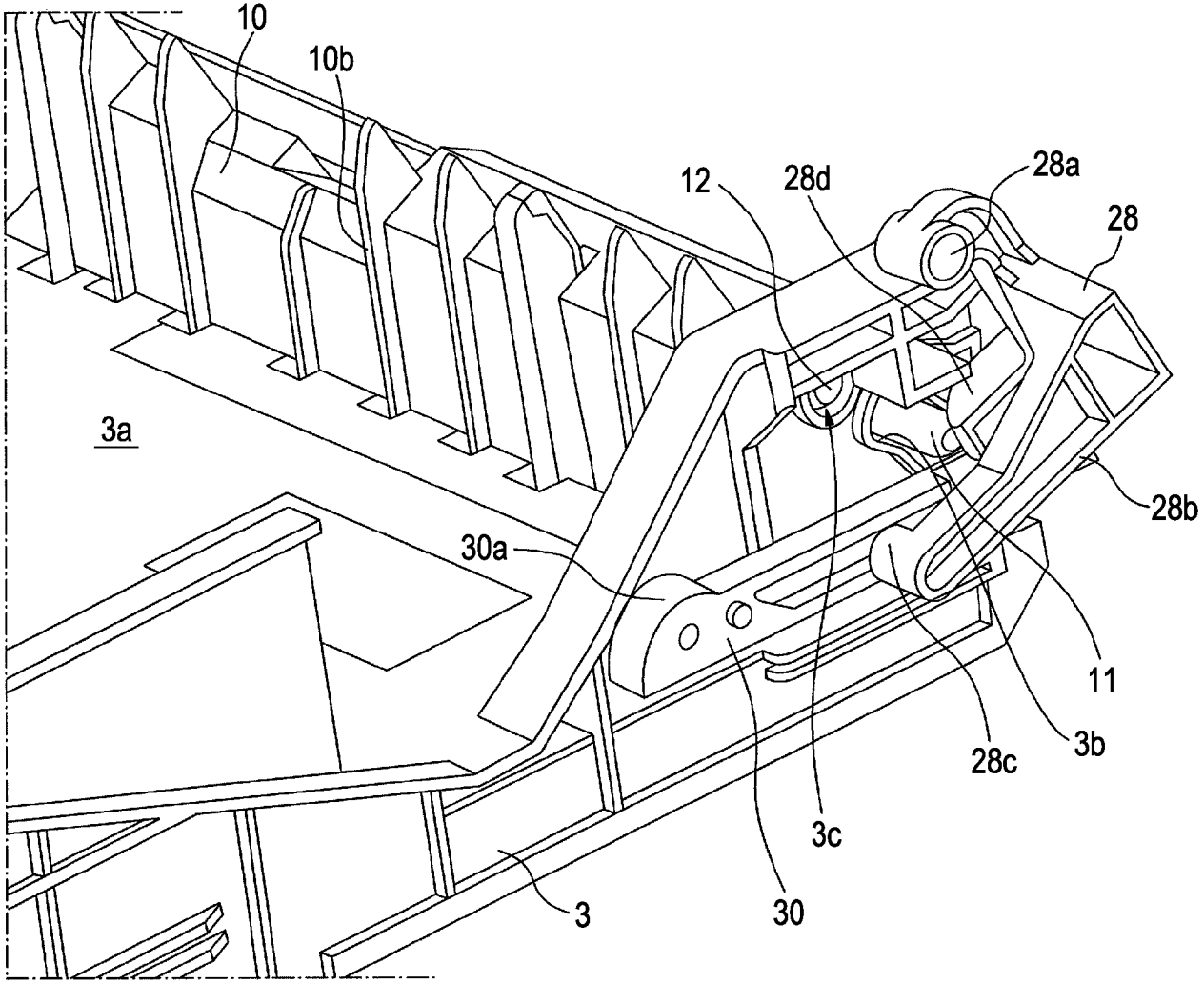
FIG. 6 is a perspective view that schematically illustrates an example of the essential components of the paper cassette and the switching means according to an exemplary embodiment of the invention.
Figure 7:
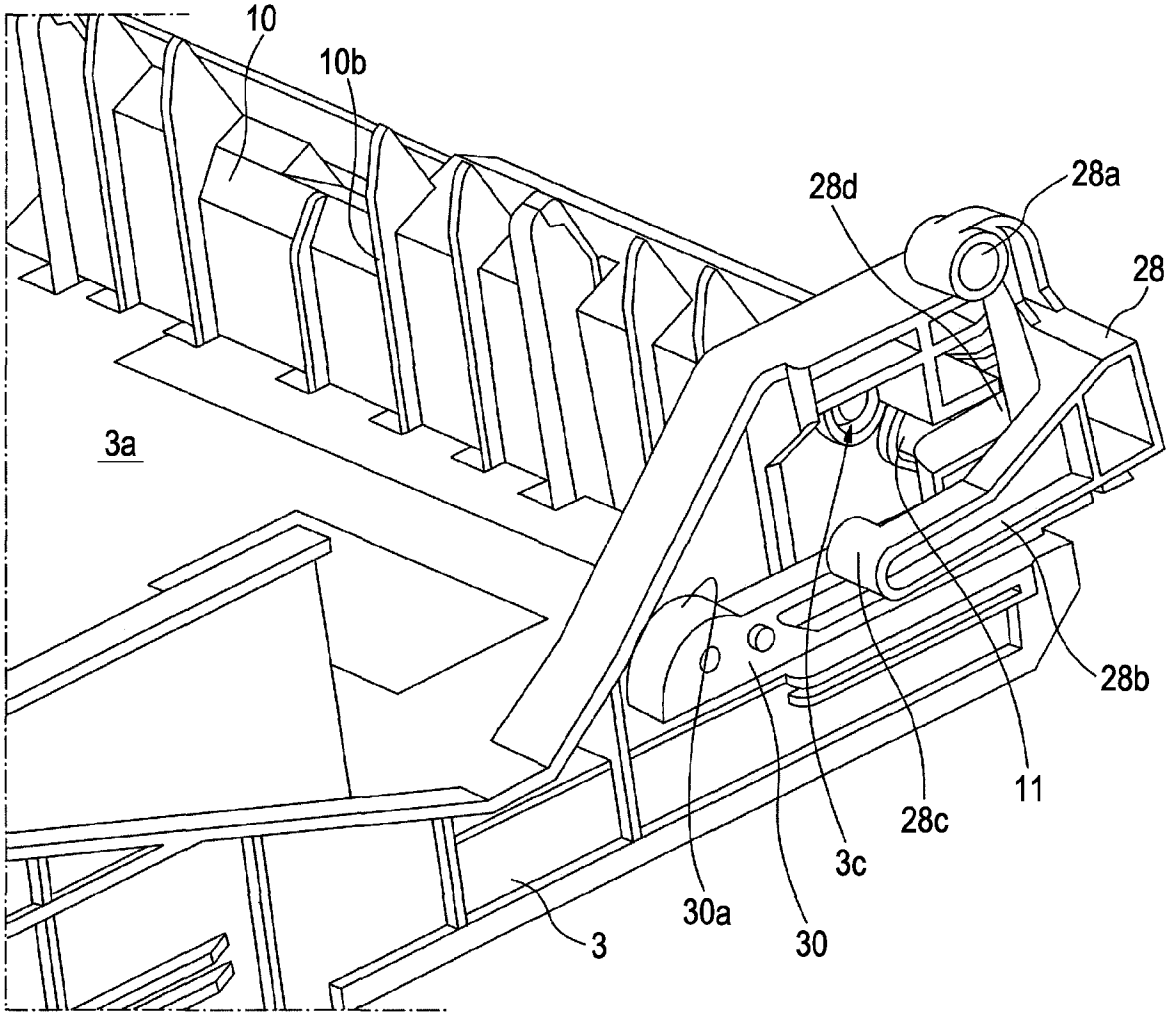
FIG. 7 is a perspective view that schematically illustrates an example of the essential components of the paper cassette and the switching means according to an exemplary embodiment of the invention.
Figure 8:
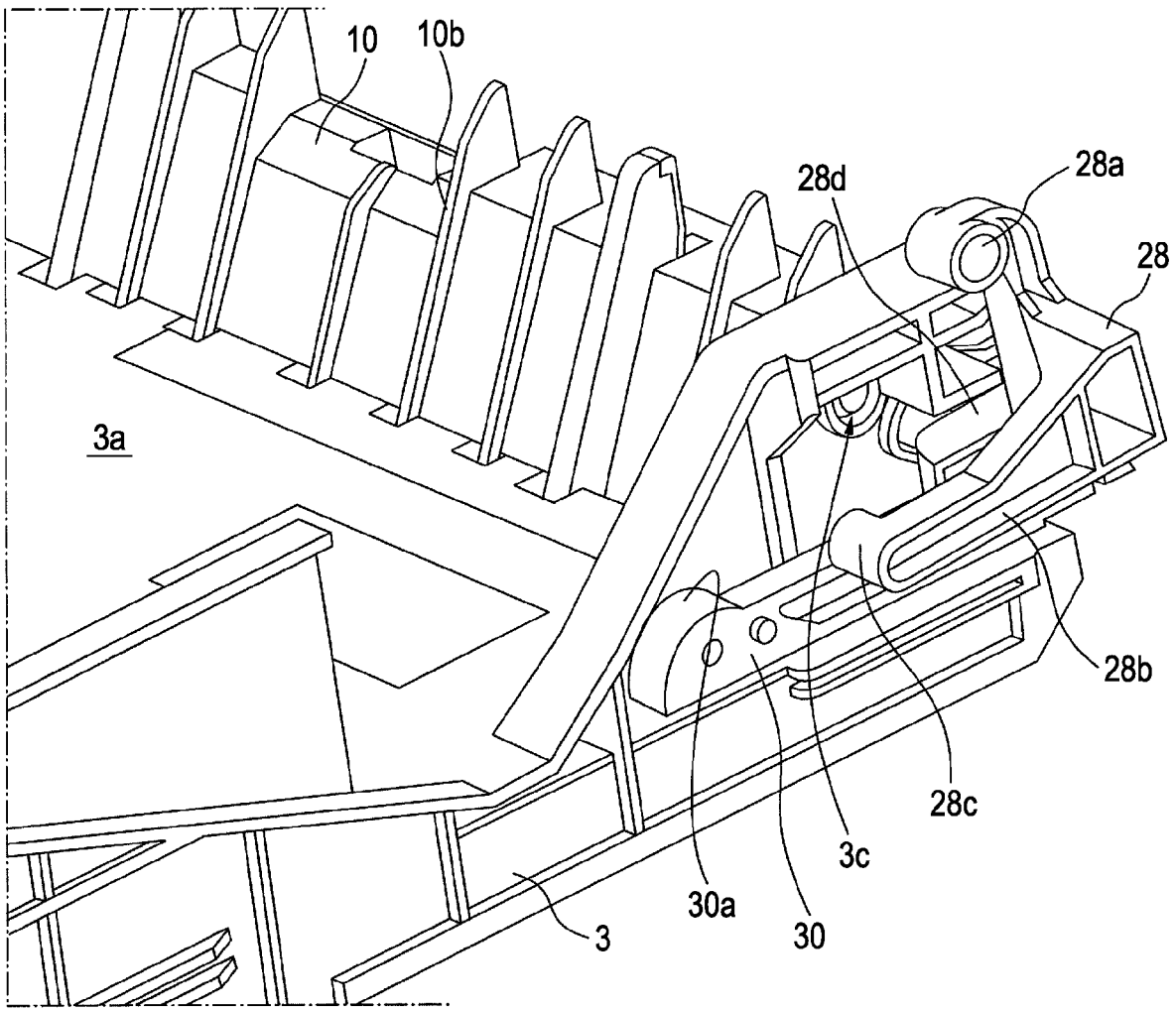
FIG. 8 is a perspective view that schematically illustrates an example of the essential components of the paper cassette and the switching means according to an exemplary embodiment of the invention.
Figure 9:
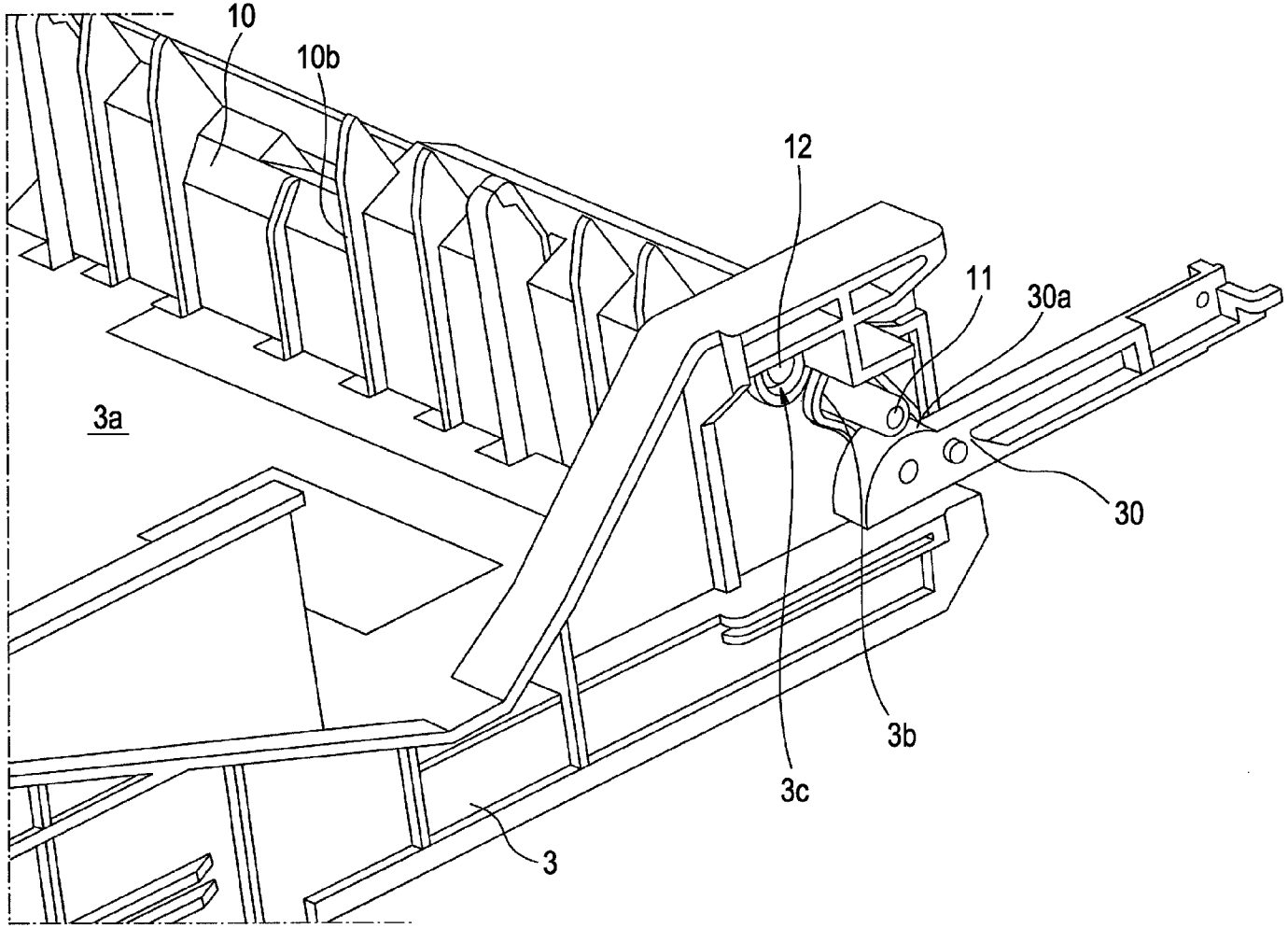
FIG. 9 is a perspective view that schematically illustrates an example of the essential components of the paper cassette and the switching means according to an exemplary embodiment of the invention.

As illustrated in FIG. 6, the boss pushing portion 28*d* can be brought into engagement (e.g., pushing contact) with the boss 11. When the lock release member 28 swivels from the state shown in FIG. 6 into the state shown in FIG. 7, the boss pushing portion 28*d* pushes the boss 11 inward. Since the boss 11 is pushed inward, the lock pin 12 becomes disengaged from the fitting hole 3*c*. As a result, since the separating member 10 swivels, the separating slope 10*b* is set into the first state (i.e., inclined) as illustrated in FIG. 8.

Next, a cam gear 25 that is provided for the swiveling operation of the lock release member 28 is explained below. The cam gear 25 can rotate around a rotating shaft 26. A cam groove 25*a* is formed through a disc face of the cam gear 25. The cam groove 25*a* is formed in the circumferential direction of the disc face of the cam gear 25. The cam groove 25*a* is an eccentric groove that has a varying distance from the center of the rotation of the cam gear 25.

Figure 5:
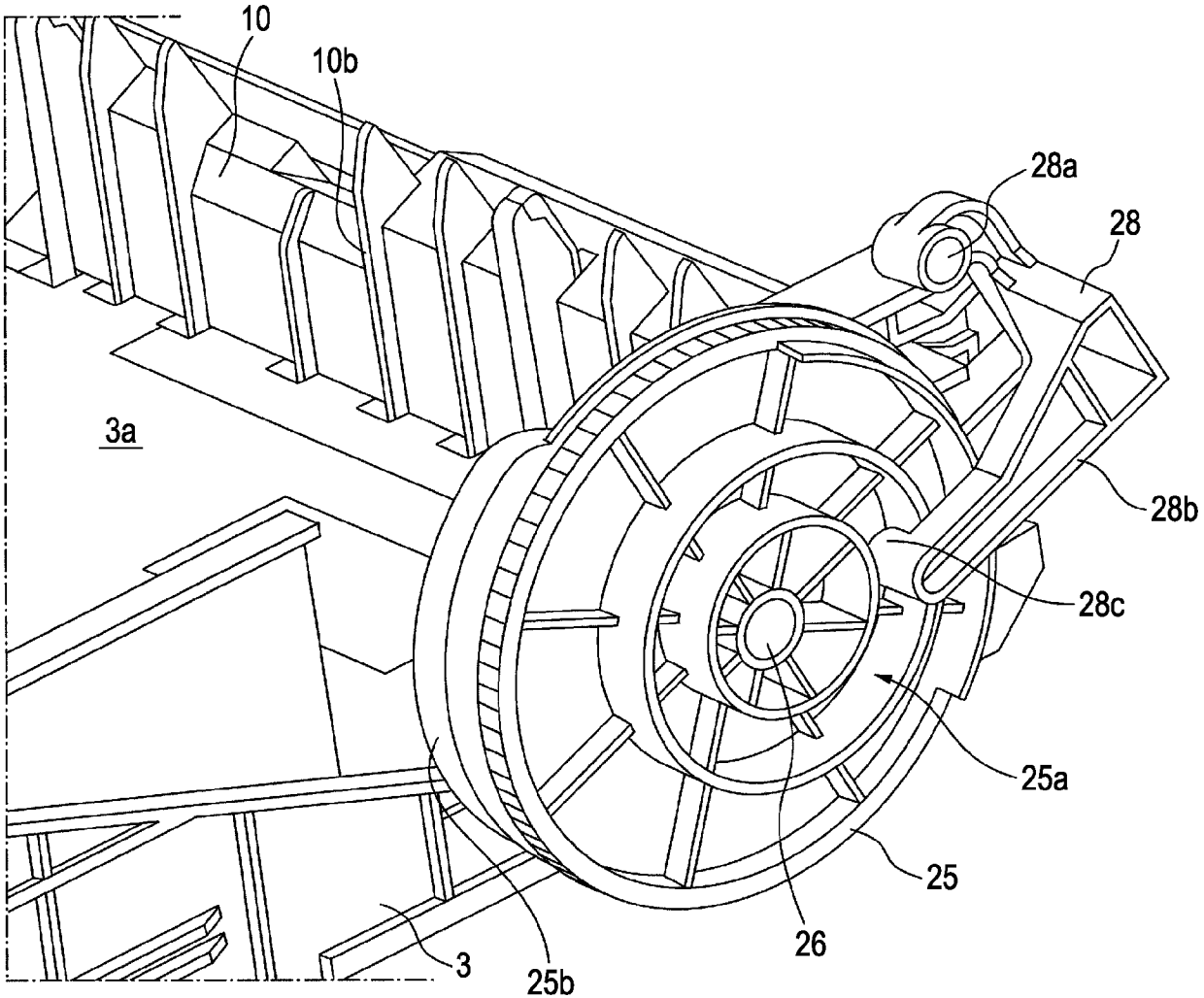
FIG. 5 is a perspective view that schematically illustrates an example of the essential components of the paper cassette and the switching means according to an exemplary embodiment of the invention.

As illustrated in FIG. 5, the boss portion 28*c* of the lock release member 28 is movably inserted in the cam groove 25*a*. Accordingly, when the cam gear 25 rotates, the position of the boss portion 28*c* changes inside the cam groove 25*a*. The lock release member 28 swivels as a result of the operation of the boss portion 28*c*. In FIGS. 3 and 4, the reference numeral 23 denotes a driving motor. The power of the driving motor 23 is transmitted to the cam gear 25 through a gear train 24.

As illustrated in FIGS. 3, 4, and 5, a cam 25*b* is formed at the opposite disc face of the cam gear 25, that is, the face opposite to the face through which the cam groove 25*a* is formed. The cam 25*b* is a member that causes the swiveling arm member 20, which supports the pickup roller 21, to swivel. A boss 20*b* is formed on a side of the swiveling arm member 20 (refer to FIG. 4). The boss 20*b* is in contact with an upper part of the cam 25*b*. The swiveling operation of the swiveling arm member 20, which brings the pickup roller 21 into contact with the recording paper P and moves the pickup roller 21 away from the recording paper P, is performed when the cam 25*b* operates.

With the above structure, the switching of the state of the separating slope 10*b* from the second state (i.e., perpendicular) to the first state (i.e., inclined) is performed by the switching means 18 in operative association with paper feeding operation. As explained above, the cam gear 25 serves as a mechanism that performs both operation for switching over the state of the separating slope 10*b* and operation for bringing the pickup roller 21 into contact with the recording paper P and moving the pickup roller 21 away from the recording paper P. Since the cam gear 25 doubles as the switching mechanism and the contact/release mechanism, it is possible to avoid a complex structure and an increase in cost.

Timing for the switching of the state of the separating slope 10*b* is explained in detail below. In a state in which the paper cassette 3 is not attached to the paper feed unit 2, the lock pin 12 is inserted in the fitting hole 3*c* to lock the separating member 10 (the separating slope 10*b*) in the second state (i.e., perpendicular). When it is set in the second state, the separating slope 10*b* gives a good feel of edge contact at the time of setting sheets of the recording paper P.

Since the switching means 18 switches the state of the separating slope 10*b* in operative association with paper feeding operation, in the present embodiment of the invention, the state of the separating slope 10*b* is kept in the second state (i.e., perpendicular) until the paper cassette 3 is attached to the paper feed unit 2 and then the initial paper feeding operation starts.

Therefore, even in a case where the paper cassette 3 is attached to the paper feed unit 2 too hard, which produces a force that acts in such a manner that the leading edge of the recording paper P is caused to run on the separating slope 10*b* if not prevented, the leading edge does not actually run on the separating slope 10*b* because the separating slope 10*b* is in the second state (i.e., perpendicular). When paper feeding operation is performed, the state of the separating slope 10*b* is switched over to the first state (i.e., inclined) before the leading edge of the recording paper P is brought into contact with the separating slope 10*b* at the latest. Therefore, the separating slope 10*b* can fulfill its separating function reliably.

The state of the separating slope 10*b* is kept in the first state (i.e., inclined) until the paper cassette 3 is detached from the paper feed unit 2 after the switching of the state thereof from the second state (i.e., perpendicular) to the first state due to the attachment of the paper cassette 3 to the paper feed unit 2 and the start of the initial paper feeding operation subsequent thereto. Though the lock release member 28 swivels not only in the initial paper feeding operation but also in the second and subsequent paper feeding operation, since the boss 11 is kept in the pushed state, it does not affect the swiveling operation of the separating member 10 at all.

Next, when the paper cassette 3 is detached from the paper feed unit 2, the state of the separating slope 10*b* is switched from the first state (i.e., inclined) to the second state (i.e., perpendicular). As illustrated in FIGS. 6 to 9, a cam member 30 is provided on the body of the paper feed unit 2 at a position opposite to a side of the paper cassette 3. The cam member 30 has a bulged portion 30*a*. The bulged portion 30*a* is brought into engagement with the boss 11 when the paper cassette 3 is detached from the paper feed unit 2.

When the paper cassette 3 is drawn for detachment, the bulged portion 30*a* lifts the boss 11. Since the boss 11 is lifted, the separating member 10 swivels to switch over the state of the separating slope 10*b* from the first state (i.e., inclined) to the second state (i.e., perpendicular). Finally, the lock pin 12 is inserted into the fitting hole 3*c* to lock the separating member 10 (the separating slope 10*b*) in the second state (i.e., perpendicular). Therefore, in a state in which the paper cassette 3 is not attached to the paper feed unit 2, the separating slope 10*b* is always locked in the second state (i.e., perpendicular). The separating slope 10*b* set in the second state gives a good feel of edge contact at the time of setting sheets of the recording paper P.

The scope of the invention is not limited to an exemplary embodiment described above. Needless to say, the invention may be, for example, modified, adapted, changed, or improved in a variety of modes. In particular, the means for switching over the state of the separating slope 10*b* and the timing of the switchover can be modified variously.

The following is a modification example. A switching means 18' shown in FIGS. 11 and 12 includes a cam member 32. A guiding groove 32*a* is formed in the cam member 32. As an example of an engagement section according to an aspect of the invention, the boss 11 is movably inserted in the guiding groove 32*a*. The boss 11 is configured to move along the guiding groove 32*a*. The shape of the guiding groove 32*a* has the following characteristics: the state of the separating slope 10*b* is switched from the second state (i.e., perpendicular) to the first state (i.e., inclined) when the paper cassette 3 is attached to the paper feed unit 2; the state of the separating slope 10*b* is switched from the first state to the second state when the paper cassette 3 is detached from the paper feed unit 2. Therefore, the separating slope 10*b* can fulfill its separating function reliably during feeding while giving a good feel of edge contact at the time of setting.

It is preferable that the state of the separating slope 10*b* should be set in the first state (i.e., inclined) at least at a point in time at which the leading edge of paper is brought into contact with the separating slope 10*b* during feeding. It is preferable that the state of the separating slope 10*b* should be set in the second state (i.e., perpendicular) at least when paper is set. More preferably, it should be set in the second state when the paper cassette 3 is attached to the paper feed unit 2 in addition to when paper is set. The timing of the switchover can be modified variously within a range that satisfies these preferred conditions.

In the foregoing embodiment of the invention, it is explained that the state of the separating slope 10*b* is kept in the first state (i.e., inclined) until the paper cassette 3 is drawn for detachment after the switching of the state thereof from the second state (i.e., perpendicular) to the first state due to the attachment of the paper cassette 3 to the paper feed unit 2 and the start of the initial paper feeding operation subsequent thereto. However, the scope of the invention is not limited to such an example. For example, the separating slope 10*b* may be set in the first state during feeding only, which means that it is set in the second state during non-feeding. That is, the state of the separating slope 10*b* may be switched over depending on paper feeding operation. With such a modification, for example, even when additional sheets of paper are set in a state in which the paper cassette 3 remains attached to the unit body, it is possible to give a good feel of edge contact.

Regarding the state of attachment of the paper cassette 3, additional sheets of paper are sometimes set in an incomplete cassette attachment state, which is a state in which the paper cassette 3 is slightly drawn from its complete attachment position. If the separating slope 10*b* is set in the second state (i.e., perpendicular) in such an incomplete cassette attachment state, it is possible to give a good feel of edge contact at the time of additional paper setting.

In the foregoing embodiment of the invention, it is explained that the angle of the separating surface 10*b* with respect to the bottom surface 3*a* of the paper cassette 3 when paper is set is 90° (i.e., perpendicular). However, the scope of the invention is not limited to such an example. It may be any other angle of inclination set steeper than the angle in the first state (i.e., inclined) so that the separating slope 10*b* can give a good feel of edge contact when paper is set, and more preferably, so that the leading edge of the recording paper P will not run on the separating slope 10*b* due to a shock during cassette attachment.

What is claimed is:

1. A recording target medium feeding apparatus comprising:

a body that includes a switching section;

a feeding section that feeds a recording target medium; and a recording target media cassette in which a plurality of the recording target media can be loaded in a stacked state, the recording target media cassette having an inner wall that faces the leading edge of the recording target medium that is to be fed, a state of the inner wall being able to be switched over between a first state and a second state, wherein, in the first state, the inner wall is inclined in recording target medium feeding orientation in such a manner that an angle of the inner wall with respect to a bottom surface of the recording target media cassette is set at a predetermined angular value, in the second state, the inner wall is set at a steeper angle of inclination in comparison with the angle in the first state, when the inner wall is set in the first state, the inner wall functions to separate the uppermost one of the recording target media, which should be fed downstream, from a second recording target medium from the top and subsequent recording target media thereunder, when the inner wall is set in the second state, the inner wall is in contact with the leading edge of the recording target media loaded in the recording target media cassette and functions to properly set the leading edge of the recording target media at a uniform edge position, the inner wall is set in the second state when the recording target media cassette is not attached to the body, when recording target medium feeding operation is performed, the switching section switches over the state of the inner wall from the second state to the first state before the leading edge of the recording target medium that is to be fed is brought into contact with the inner wall at the latest, and the switching section keeps the state of the inner wall in the second state until the recording target media cassette with the inner wall being set in the second state is attached to the body and then initial recording target medium feeding operation starts;

wherein the recording target media cassette includes an engagement section that is brought into engagement with the switching section when the recording target media cassette is attached to or detached from the body of the recording target medium feeding apparatus;

the state of the inner wall is switched over from the second state to the first state when the recording target media cassette is attached to the body; and the state of the inner wall is switched over from the first state to the second state when the recording target media cassette is detached from the body;

wherein the recording target media cassette further includes a swiveling member and a posture holding section;

the swiveling member has the inner wall and swivels to switch over the state of the inner wall;

the posture holding section holds posture of the swiveling member when the inner wall is in the second state;

the posture holding section can be brought into engagement with the switching section; and the swiveling member is configured to swivel in such a manner that the state of the inner wall is switched into the first state due to weight of the swiveling member of its own in a state in which the holding of the posture of the swiveling member by the posture holding section is released.

2. The recording target medium feeding apparatus according to claim 1, wherein the posture holding section includes a lock pin that is provided on the swiveling member;

the lock pin can move into and out of a fitting hole that is formed adjacent to the swiveling member;

the lock pin is urged toward the fitting hole;

the lock pin is inserted into the fitting hole to hold the posture of the swiveling member;

the switching section includes a lock release member that can be brought into engagement with the lock pin or a lock member that includes the lock pin; and the lock release member is brought into engagement with the lock pin or the lock member in operative association with operation of feeding the recording target medium by the feeding section to disengage the lock pin from the fitting hole.

3. The recording target medium feeding apparatus according to claim 2, wherein power of a power source for the feeding section is utilized for mechanically operating the lock release member to disengage the lock pin from the fitting hole.

4. The recording target medium feeding apparatus according to claim 3, wherein a cam member is provided on the body of the recording target medium feeding apparatus at a position adjacent to the recording target media cassette; and the swiveling member is brought into engagement with the cam member to switch over the state of the inner wall from the first state to the second state when the recording target media cassette is detached from the body.

* * * * *